US006504465B2

(12) United States Patent
Matsumoto

(10) Patent No.: US 6,504,465 B2
(45) Date of Patent: Jan. 7, 2003

(54) ELECTROMAGNETIC COIL ASSEMBLY FOR ELECTROMAGNETIC APPARATUS

(75) Inventor: Hideyuki Matsumoto, Isesaki (JP)

(73) Assignee: Sanden Corporation, Gunma (JP)

( * ) Notice: Subject to any disclaimer, the term of this patent is extended or adjusted under 35 U.S.C. 154(b) by 51 days.

(21) Appl. No.: 09/845,324

(22) Filed: May 1, 2001

(65) Prior Publication Data

US 2001/0048357 A1 Dec. 6, 2001

(30) Foreign Application Priority Data

May 23, 2000 (JP) ..... 2000-155951

(51) Int. Cl.[7] ..... H01F 27/29
(52) U.S. Cl. ..... 336/192; 336/208; 361/35
(58) Field of Search ..... 336/192, 208, 336/198; 361/35, 37–39, 41, 833, 834

(56) References Cited

U.S. PATENT DOCUMENTS

| | | | | |
|---|---|---|---|---|
| 3,585,450 A | | 6/1971 | Lane | |
| 4,132,913 A | * | 1/1979 | Lautner et al. | 310/68 |
| 4,181,393 A | | 1/1980 | Lill | |
| 4,404,534 A | | 9/1983 | Janvrin | |
| 4,419,536 A | | 12/1983 | Doyle et al. | |
| 4,429,358 A | | 1/1984 | Miyagi | |
| 4,432,446 A | | 2/1984 | Okano et al. | |
| 4,557,544 A | | 12/1985 | Esser | |
| 4,623,754 A | | 11/1986 | Kikuchi et al. | |
| 4,935,713 A | | 6/1990 | Bekheet | |
| 5,121,093 A | | 6/1992 | Matsushita | |
| 5,138,293 A | | 8/1992 | Ishimaru | |
| 5,225,801 A | | 7/1993 | Ida et al. | |
| 5,307,038 A | | 4/1994 | Ishimaru | |
| 5,320,206 A | | 6/1994 | Maejima | |
| 5,483,405 A | * | 1/1996 | Kaelin | 361/38 |
| 5,508,671 A | | 4/1996 | Takashi | |
| 5,689,182 A | * | 11/1997 | Togo et al. | 324/207.15 |
| 5,889,455 A | | 3/1999 | Sakamoto | |
| 6,053,448 A | | 4/2000 | Sakamoto | |
| 6,069,547 A | | 5/2000 | Sakamoto | |
| 6,091,590 A | | 7/2000 | Sakamoto | |

FOREIGN PATENT DOCUMENTS

| | | |
|---|---|---|
| GB | 2248969 | 4/1992 |
| JP | 56138529 | 10/1981 |
| JP | 2106007 | 4/1990 |
| JP | 8247171 | 9/1996 |

* cited by examiner

*Primary Examiner*—Anh Mai
(74) *Attorney, Agent, or Firm*—Baker Botts L.L.P.

(57) ABSTRACT

An electromagnetic coil assembly for an electromagnetic apparatus has a bobbin, a coil formed of an electrical wire wound a spool of the bobbin, a thermal protection device including a pair of lead wires, a first and a second lead wire, extending from thereof. A securing member having a groove-shaped cross-section is securely disposed on a first end surface of the bobbin. The securing member extends on the first end surface and crosses at a right angle to the radial axis of the spool, such that the thermal protection device is inserted into a groove of the securing member. A height of a first side wall of the securing member, which is positioned radially outward on the first end surface, is lower than a height of a second side wall of the securing member, which is positioned radially inward on the first end surface.

4 Claims, 3 Drawing Sheets

ELECTROMAGNETIC COIL ASSEMBLY FOR ELECTROMAGNETIC APPARATUS

BACKGROUND OF THE INVENTION

1. Field of the Invention

The present invention relates to an electromagnetic coil assembly for use in an electromagnetic apparatus, such as an electromagnetic clutch for use in controlling the transmission of power from an automobile engine to a refrigerant compressor in an automobile air conditioning system. More particularly, it relates to the structure for a securing member, which secures a thermal protection device in the electromagnetic coil assembly.

2. Description of Related Art

Referring to FIGS. 1 and 2, an electromagnetic coil assembly 4, which comprises a bobbin 1 and a coil 3, is known in the art. Bobbin 1 has a toroidal shape having a spool portion, which has an exterior open edge. Coil 3 is formed of an electrical wire 2, which is wound around the spool portion. An electromagnetic coil assembly 4, for example, is used in an electromagnetic clutch 6 of a compressor 5 in an automobile air conditioning system, as shown in FIG. 3. Electromagnetic coil assembly 4 may be provided with a thermal protection device 7, eg., a thermal fuse or a thermal switch, which is sensitive to high temperatures in electromagnetic clutch 6. Thermal protection device 7 isolates a power source, such as an automobile engine, to protect electromagnetic clutch 6 and compressor 5 when high temperatures due to friction between the parts in electromagnetic clutch 6 are generated.

Referring again to FIGS. 1 and 2, in electromagnetic coil assembly 4, thermal protection device 7 has a pair of leads, a first lead 7*a* and a second lead 7*b*, extending from either end of thermal protection device 7. An end of first lead 7*a* of thermal protection device 7 is connected to a wire end portion 2*a* of electrical wire 2 through a first caulking terminal 8. An end of second lead 7*b* of thermal protection device 7 is connected to a third lead 9, which is connected to the external power source (not shown), through a second caulking terminal 10. Thermal protection device 7, first lead 7*a* and second lead 7*b*, wire end portion 2*a*, and a beginning portion of third lead 9 are disposed on a first end surface 1*a* of bobbin 1. A pair of projection portions, a first projection portion 12*a* and a second projection portion 12*b*, are formed on first end surface 1*a*. Moreover, a securing member 11 having a groove-shaped cross-section, which is integrally molded with bobbin 1, is disposed on a first end surface la of bobbin 1. Securing member 11 extends on first end surface 1*a* and crosses at a right angle to the radial axis of the spool portion of bobbin 1. An open edge of a groove of securing member 11 formed opposite to first end surface 1*a*.

When thermal protection device 7, first caulking terminal 8, and second caulking terminal 10 are disposed on first end surface 1a of bobbin 1; a wire portion, which consists of wire end portion 2*a* of electrical wire 2 through beginning portion of third lead 9, is drawn along the circumference of first end surface 1*a*. First lead 7*a* of thermal protection device 7 is secured by first projection portion 12*a* from the exterior open edge of bobbin 1. Thereafter, thermal protection device 7 is inserted into the groove of securing member 11, and second lead 7*b* of thermal protection device 7 is secured by second projection portion 12*b* from the exterior open edge of bobbin 1. Thus, thermal protection device 7, first caulking terminal 8, and second caulking terminal 10 are secured on first end surface 1*a* of bobbin 1.

As shown in FIG. 4, in electromagnetic coil assembly 4, the groove of securing member 11 is formed of a first side wall 11*a*, which is positioned radially outward on first end surface 1*a*, and a second side wall 11*b*, which is positioned radially inward on first end surface 1*a*. A height of first side wall 11*a* is the same as a height of second side wall 11*b*. Therefore, thermal protection device 7 is inserted into the groove of securing member 11 from a direction perpendicular to the groove, as shown in the arrow of FIG. 4.

With respect to securing thermal protection device 7, the insertion of thermal protection device 7 into the groove of securing member 11 from the perpendicular direction may not be done in a series of steps, which consist of drawing the wire portion along the circumference of first end surface 1*a*, and securing first lead 7*a* and second lead 7*b* by projection portion 12*a* and projection portion 12*b*. When thermal protection device 7 is inserted into securing member 11 from a direction above and perpendicular to the groove of securing member 11, the steps of drawing the wire portion along the circumference of first end surface 1*a* may be interrupted. As a result, the efficiency of the process of securing thermal protection device 7, first caulking terminal 8, and a second caulking terminal 10 on first end surface of bobbin 1 may be reduced.

SUMMARY OF THE INVENTION

A need has arisen to provide an electromagnet assembly for use in an electromagnetic apparatus which has an improved efficiency in fixing a thermal protection device and caulking terminals to an end surface of a coil bobbin, when compared with a known electromagnet assembly.

In an embodiment of the present invention, an electromagnetic coil assembly for an electromagnetic apparatus comprises a bobbin, a coil, and a thermal protection device. The bobbin comprises a cylindrical tubular spool, and a pair of annular flanges projecting radially from the spool to form an exterior open edge. The coil is formed of an electrical wire. The electrical wire is wound around the spool between the flanges. The thermal protection device has a first and a second lead wire, each extending from one side thereof. The first lead wire is connected to one end of the electrical wire through a first connecting member. The second lead wire is connected to one end of a third lead wire of an electrical circuit through a second connecting member. The thermal protection device, the first lead wire, the second lead wire, the first connecting member, the second connecting member, one end of the electrical wire, and one end of the third lead wire are disposed on a first end surface of the bobbin. A securing member having a groove-shaped cross-section is securely disposed on the first end surface of the bobbin. The securing member extends on the first end surface and crosses at a right angle to a radial axis of the spool, such that the thermal protection device is inserted into a groove of the securing member. A height of a fist side wall of the securing member, which is positioned radially outward on the first end surface, is lower than a height of a second side wall of the securing member, which is radially inward on the first end surface.

Other objects, features, and advantages will be apparent to persons of ordinary skill in the art from the following description of the invention with reference to the accompanying drawings.

BRIEF DESCRIPTION OF THE DRAWINGS

The present invention may be more readily understood with reference to the following drawings.

DETAILED DESCRIPTION OF PREFERRED EMBODIMENTS

Figure 1:
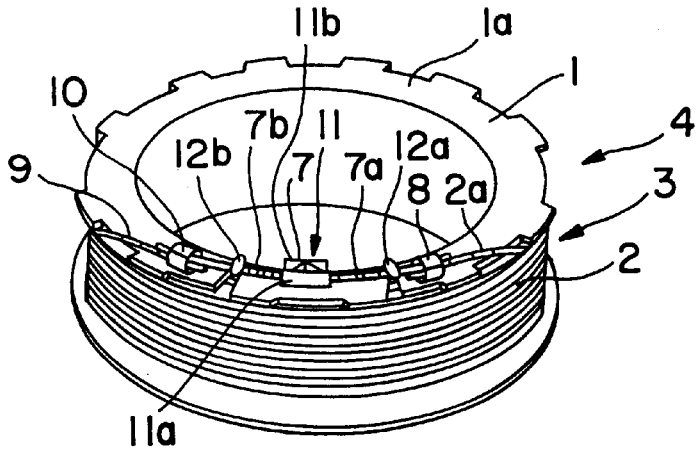
FIG. 1 (PRIOR ART)
FIG. 1 is a perspective and exploded view of a sown electromagnetic coil assembly.
Figure 2:
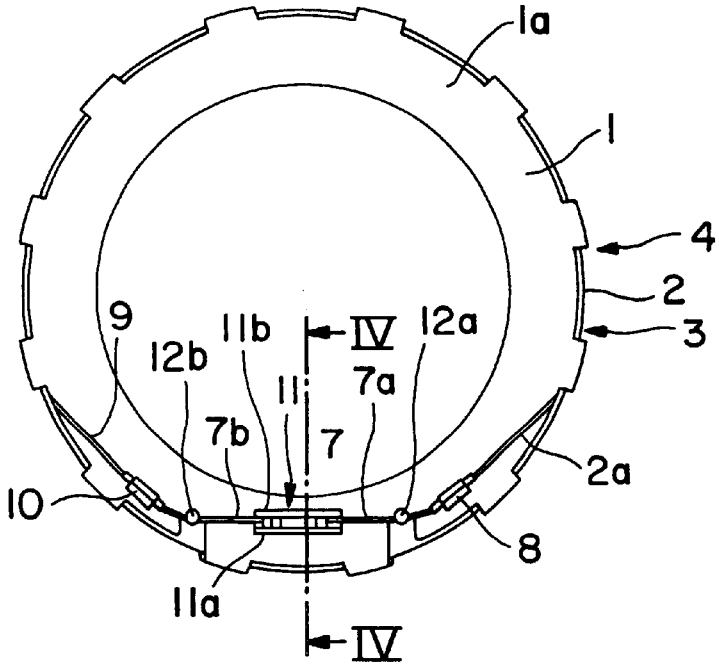
FIG. 2 (PRIOR ART)
FIG. 2 is a plan view of a first end surface of a bobbin of the known electromagnetic coil assembly.
Figure 3:
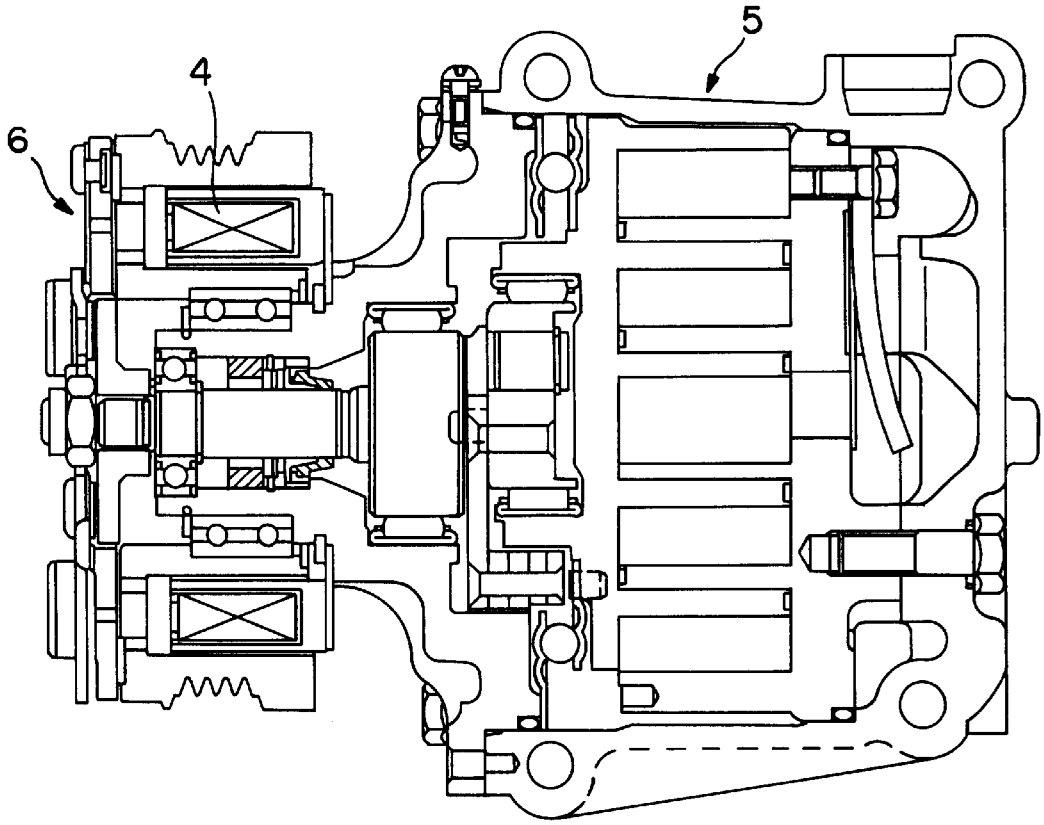
FIG. 3 (PRIOR ART)
FIG. 3 is a longitudinal, cross-sectional view of a known compressor for use in an automotive air-conditioning system, which includes an electromagnetic clutch having an electromagnetic coil assembly.
Figure 4:
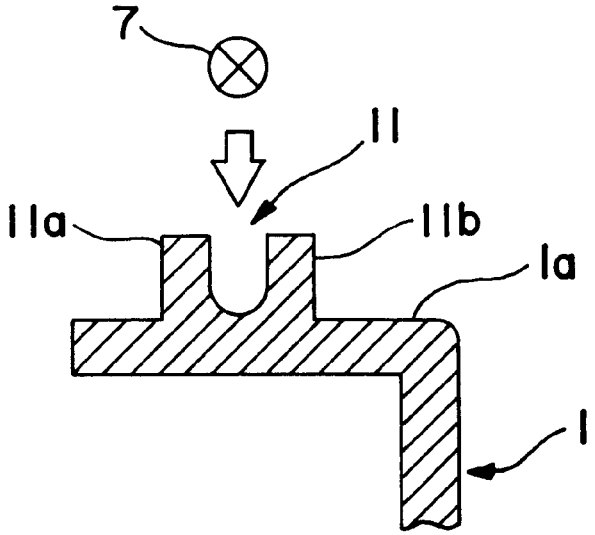
FIG. 4 (PRIOR ART)
FIG. 4 is a cross-sectional view taken along the line IV—IV of FIG. 2.
Figure 5:
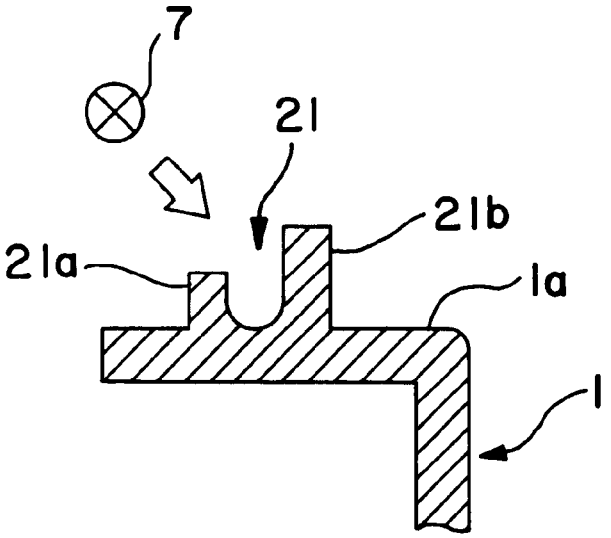
FIG. 5 is a cross-section view, which corresponds to FIG. 4, of an electromagnetic coil assembly for use in an electromagnetic apparatus, according to an embodiment of the present invention.

Referring to FIG. 5, an electromagnetic coil assembly of an embodiment of the present invention is shown. In the following explanation, the same reference numbers are used to represent the same parts of an electromagnetic coil assembly 4 as shown in FIGS. 1, 2, and 4. Therefore, further explanation of similar parts is here omitted. A securing member 21 having a groove-shaped cross-section, which is integrally molded with a bobbin 1, is disposed on a first end surface 1*a* of bobbin 1. Securing member 21 extends on first end surface 1*a* and crosses at a right angle to the radial axis of the spool portion of bobbin 1. An open edge of a groove of securing member 11 has the same direction of first end surface 1*a*. The groove of securing member 21 is formed of a first side wall 21*a*, which is positioned radially outward on first end surface 1*a*, and second side wall 21*b*, which is positioned radially inward on first end surface 1*a*. A height of first side wall 21*a* is lower than a height of second side wall 21*b*. The remaining structure of the electromagnetic coil assembly of this embodiment is substantially the same as electromagnetic coil a is shown in FIGS. 1, 2, and 4.

Referring again to FIG. 5, in the electromagnetic coil assembly of the present invention, a thermal protection device 7 is inserted into the groove of securing member 21 obliquely from above and radially outwardly, as shown in the arrow of FIG. 5. A process of inserting thermal protection device 7 into the groove of securing member 21 obliquely from above and radially outwardly may be done in a series of steps, which consist of drawing the wire portion along the circumference of first end surface 1*a*, securing a first lead 7*a* by a first projection portion 12*a*, and securing a second lead 7*b* by a second projection portion 12*b*. Therefore, the process of drawing the wire portion along the circumference of first end surface 1*a* may not be done with interruption due to the insertion of thermal protection device 7 into the groove of securing member 21. As a result, the process of securing thermal protection device 7, a first caulking terminal 8, and a second caulking terminal 10 may increase in efficiency compared to that of a known electromagnetic coil assembly 4.

In the above described embodiment, securing member 21 is integrally molded with bobbin 1. Securing member 21 is fixedly disposed on first end surface 1*a* of bobbin 1, therefore, it is within the contemplation of the present invention that securing member 21 is fixed, e.g., welded securely or secured adhesively, to first end surface 1*a* of bobbin 1.

As described above, in the embodiment of the present invention of an electromagnetic coil assembly, a height of a first side wall of a securing member, which is positioned radially outward on a first end surface of a bobbin, is lower than a height of a second side wall of the securing member, which is positioned radially inward on the first end surface of the bobbin. Therefore, a thermal protection device is inserted into a groove of the securing member obliquely from above and radially outwardly. Moreover, a process of inserting the thermal protection device into the groove of the securing member may be done in a series of steps, which consist of drawing the wire portion along the circumference of the first end surface, securing a first lead by a first projection portion, and securing a second lead 7 by a second projection portion. As a result, the efficiency of securing the thermal protection device, a first caulking terminal, and a second caulking terminal may increase compared to that of a Known electromagnetic coil assembly.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. An electromagnetic coil assembly for an electromagnetic apparatus comprising:

a bobbin including a cylindrical tubular spool and a pair of annular flanges projecting radially from said spool;

a coil formed of an electrical wire, said electrical wire wound around said spool between said flanges;

a thermal protection device having a first and a second lead wire, each extending from one side thereof, said first lead wire connected to one end of said electrical wire through a first connecting member, said second lead wire connected to one end of a third lead wire of an electric circuit through a second connecting member, said thermal protection device, said first lead wire, said second lead wire, said first connecting member, said second connecting member, one end of said electrical wire, one end of said third lead wire disposed on a first end surface of said bobbin; and a securing member having a groove-shaped cross-section, which is securely disposed on said first end surface, said securing member extending on said first end surface and crossing at a right angle to a radial axis of said spool, such that said thermal protection device is inserted into a groove of said securing member, wherein a height of a first side wall of said securing member, which is positioned radially outward on said first end surface, is lower than a height of a second side wall of said securing member, which is positioned radially inward on said first end surface.

2. The electromagnetic coil assembly for claim 1, said securing member is integrally molded with said bobbin.

3. The electromagnetic coil assembly for claim 1, said securing member is welded securely to said first end surface of said bobbin.

4. The electromagnetic coil assembly for claim 1, said securing member is secured adhesively to said first end surface of said bobbin.

* * * * *